US007311278B2

(12) United States Patent
Kitsukawa et al.

(10) Patent No.: US 7,311,278 B2
(45) Date of Patent: Dec. 25, 2007

(54) CRUSHER BUCKET WITH CRUSHING LID

(75) Inventors: Tomohiro Kitsukawa, Takeo (JP); Tomio Aimori, Takeo (JP); Tadaaki Tomonaga, Takeo (JP); Arata Fukuda, Takeo (JP)

(73) Assignee: Nakayama Iron Works, Ltd., Saga (JP)

( * ) Notice: Subject to any disclaimer, the term of this patent is extended or adjusted under 35 U.S.C. 154(b) by 242 days.

(21) Appl. No.: 11/134,520

(22) Filed: May 23, 2005

(65) Prior Publication Data

US 2005/0263631 A1 Dec. 1, 2005

(30) Foreign Application Priority Data

May 24, 2004 (JP) ..... 2004-153564
Feb. 15, 2005 (JP) ..... 2005-037657

(51) Int. Cl.
*B02C 9/04* (2006.01)

(52) U.S. Cl. ..... 241/101.72; 241/194

(58) Field of Classification Search ..... 241/189.1, 241/194, 285.3, 101.72
See application file for complete search history.

(56) References Cited

U.S. PATENT DOCUMENTS 5,484,110 A * 1/1996 Doppstadt ..... 241/86.1
5,890,666 A * 4/1999 Folling et al. ..... 241/189.1
6,070,819 A * 6/2000 Young et al. ..... 241/189.1
6,871,807 B2 * 3/2005 Rossi, Jr. ..... 241/101.72
2003/0038196 A1 * 2/2003 Moriya et al. ..... 241/30

FOREIGN PATENT DOCUMENTS

| | | |
|---|---|---|
| JP | 9-88355 | 3/1997 |
| JP | 10-30247 | 2/1998 |
| JP | 2001-113198 | 4/2001 |
| JP | 2001-190972 | 7/2001 |

* cited by examiner

*Primary Examiner*—Faye Francis
(74) *Attorney, Agent, or Firm*—Westerman, Hattori, Daniels & Adrian, LLP.

(57) ABSTRACT

A crusher bucket includes a bucket body (70) and a crushing lid (76) provided on the bucket body. The crushing lid is capable of being opened and closed relative to the bucket body. A material feed rate adjusting mechanism is provided on the bucket body (70) and/or the crushing lid (76) to allow raw material scooped up into the bucket body (70) to be fed into a crushing chamber (70*a*) in a predetermined amount at a time. Hammers (74) are disposed on the outer periphery of a rotor driven rotationally by a power drive device to strike and break the raw material fed into the crushing chamber (70*a*). A repulsion plate (77) is provided on the crushing lid (76) to collide with the raw material struck by the hammers (74). The material feed rate adjusting mechanism is preferably a weir (72) provided on the bottom wall of the bucket body (70).

4 Claims, 8 Drawing Sheets

CRUSHER BUCKET WITH CRUSHING LID

BACKGROUND OF THE INVENTION

1. Field of the Invention

The present invention relates to a crusher bucket with a crushing lid for recycling lumps of asphalt, scraps of concrete, etc. More particularly, the present invention relates to a crusher bucket attached to the distal end of an arm of a civil engineering machine and having the function of crushing raw materials. Even more particularly, the present invention pertains to a crusher bucket with a crushing lid improved in maintainability and productivity.

2. Discussion of Related Art

A civil engineering machine that is generally called "impact crusher" crushes and grinds material to be crushed (raw material) such as industrial waste, i.e. concrete scraps, asphalt paving mixture, aggregate for civil engineering and construction applications, or crushed stone. The crushed materials are reused as recycling materials. The impact crusher has a rotor with a horizontal axis in a casing. The rotor has a plurality of hammers radially arranged thereon. Material to be crushed is loaded into the crusher with the rotor rotating. The material is impacted between the rotor and a repulsion plate secured to the casing inner surface, thereby being crushed. The hammers mounted on the rotor are always in direct contact with the raw material under impact force. Therefore, the distal end portions of the hammers wear out as the service time of the crusher elapses.

Generally, the distal end portions of the hammers become worn out to a considerable extent when a predetermined time has elapsed. As a result, the crushing efficiency degrades markedly. Meanwhile, if a large amount of material to be crushed is fed at a time into the crushing chamber in which the hammers are rotating, the material is likely to be caught between the casing body (the bucket body) and the hammers, causing an interruption of the crushing operation. If the material to be crushed gets caught in this way, it becomes necessary to perform an operation of disassembling the hammers to release and remove the caught material. Regarding the hammer mounting structure, the present applicant proposed a technique whereby after a hammer has been inserted into a cut portion of a rotor body, an engaging projection is fitted into an engaging hole formed in a retaining block to support the hammer, and the retaining block is supported between support members, thereby securing the hammer [see Japanese Utility Model Unexamined Publication (KOKAI) No. Hei 4-45547 and Japanese Patent Unexamined Publication (KOKAI) No. 2001-190972].

The hammers of stationary impact crushers are stationary. There is, however, known a small-sized crusher in which hammers are pivotably supported on pivot shafts to crush raw material by the pivotal motion of the hammers. The pivoted hammers can be used also as members for mixing clayish soil with air or a soil conditioner, e.g. a stabilizer, and stirring the mixture. Replacement of the hammers is generally made by removing the pivot shafts pivotably supporting the hammers.

Conventionally, scrap materials such as asphalt lumps are reprocessed at a site where a recycling plant is installed. This method requires a great deal of energy, time and cost to transport scrap materials from the site where they are generated to the reprocessing site. Therefore, there have recently been proposed methods wherein a small amount of recyclable material is directly reprocessed at a site where it is generated. Among these are methods wherein recyclable material is reprocessed in a bucket of a civil engineering machine. Many proposals have been made regarding the method and structure of crushing in the crusher bucket [for example, see Japanese Patent Unexamined Publication (KOKAI) Nos. Hei 9-88355, Hei 10-30247 and 2001-113198].

When material to be crushed gets caught between the crusher hammers and the casing body, an operation of removing and remounting the hammers and so forth has to be performed to release and remove the caught material. When becoming worn or damaged, the hammers need to be replaced with new ones. The hammer replacing operation plus the hammer removing and remounting operation increases downtime for maintenance and degrades productivity. Further, impact hammers require the hammer replacing operation to be carried out relatively frequently. Because these hammers are small in size, the space for the replacing operation is narrow and it is difficult to perform the operation. Therefore, the hammer removing or replacing operation has to be done as efficiently as possible. In the case of pivoted impact hammers, in particular, the pivot shafts need to be removed in order to replace the hammers, and it is necessary to temporarily remove another hammer that is provided on the same pivot shaft as the one to be replaced and that need not be replaced.

Thus, there has been a demand for development of a crusher bucket with a crushing lid improved in maintainability and productivity. More specifically, it has been demanded to provide a crusher bucket arranged so that material to be crushed will not easily be caught between the bucket body and the hammers, etc., thereby minimizing the likelihood of occurrence of an event requiring the material removing operation, and in the event that material to be crushed gets caught, the hammer removing and remounting operation can be readily performed to remove the caught material.

SUMMARY OF THE INVENTION

The present invention was made to solve the above-described problems and to attain the following objects.

An object of the present invention is to provide a crusher bucket with a crushing lid that is arranged so that raw material (material to be crushed) is fed into the crushing chamber in a predetermined amount at a time, thereby making it unlikely that the raw material will be caught between the bucket body and the hammers, etc.

Another object of the present invention is to provide a crusher bucket with a crushing lid that facilitates the hammer removing and remounting or replacing operations to improve maintainability and productivity.

To attain the above-described objects, according to a first feature thereof, the present invention provides a crusher bucket including a bucket body and a crushing lid provided on the bucket body. The crushing lid is capable of being opened and closed relative to the bucket body. A material feed rate adjusting mechanism is provided on the bucket body and/or the crushing lid to allow raw material scooped up into the bucket body to be fed into a crushing chamber in a predetermined amount at a time. Hammers are disposed on the outer periphery of a rotor driven rotationally by a power drive device to strike and break the raw material fed into the crushing chamber. A repulsion plate is provided on the crushing lid to collide with the raw material struck by the hammers.

According to a second feature of the present invention, the material feed rate adjusting mechanism of the crusher bucket according to the first feature of the present invention is a weir provided on the bottom wall of the bucket body.

According to a third feature of the present invention, each of the hammers in the crusher bucket according to the first or second feature of the present invention has an opening open outward and a cut portion communicating with the opening. The cut portion is formed with a bearing that supports the hammer when the rotor rotates. A hammer pivot shaft is inserted into the bearing through the opening during assembly process to pivotably support the hammer. A hammer retainer is inserted into the opening and secured to the hammer. The crusher bucket further includes a securing member for securing the hammer and the hammer retainer to each other.

According to a fourth feature of the present invention, the crusher bucket according to the third feature of the present invention further includes a mutually connecting mechanism whereby the hammer and the hammer retainer are detachably connected to each other. The mutually connecting mechanism includes first engaging elements formed at the opposite ends of the opening of the hammer. Second engaging elements to be detachably engaged with the first engaging elements are formed on the hammer retainer.

According to a fifth feature of the present invention, the hammer retainer in the crusher bucket according to the third feature of the present invention has two hammer retainer members provided facing each other. The crusher bucket further includes a mutually connecting mechanism whereby the hammer and the hammer retainer are detachably connected to each other. The mutually connecting mechanism includes first engaging elements formed at two positions in the cut portion of the hammer in the radial direction of the bearing. Second engagement elements to be detachably engaged with the first engaging elements are formed on the hammer retainer members, respectively.

The crusher bucket with a crushing lid according to the present invention has a material feed rate adjusting mechanism, e.g. a weir, provided on the bottom wall of the bucket body. With this arrangement, raw material can be fed into the crushing chamber in a predetermined amount at a time. Therefore, there is substantially no possibility of raw material getting caught between the bucket body and the hammers, etc. Accordingly, there is a marked reduction in the incidence of an event requiring an operation for removing caught raw material or the like. In addition, it is possible to readily remove and remount a pivoted impact hammer without the need to remove the pivot shaft supporting the hammer. In other words, it is possible to improve the crusher bucket in maintainability in the real sense of the term.

In addition, the amount of time required for maintenance of the crusher other than the time for crushing operation, i.e. downtime, is minimized, and hence the productivity of the crusher is improved.

The above and other objects, features and advantages of the present invention will become more apparent from the following description of the preferred embodiments thereof, taken in conjunction with the accompanying drawings.

BRIEF DESCRIPTION OF THE DRAWINGS

FIGS. 13(*c*) and 13(*d*) are a front view and a left-hand side view, respectively, showing a second hammer retainer member of the second hammer removably securing mechanism.

DESCRIPTION OF THE PREFERRED EMBODIMENTS

Embodiments of the present invention will be described below with reference to the accompanying drawings.

[A Crusher Bucket with a Crushing Lid According to a First Embodiment]

Figure 1:
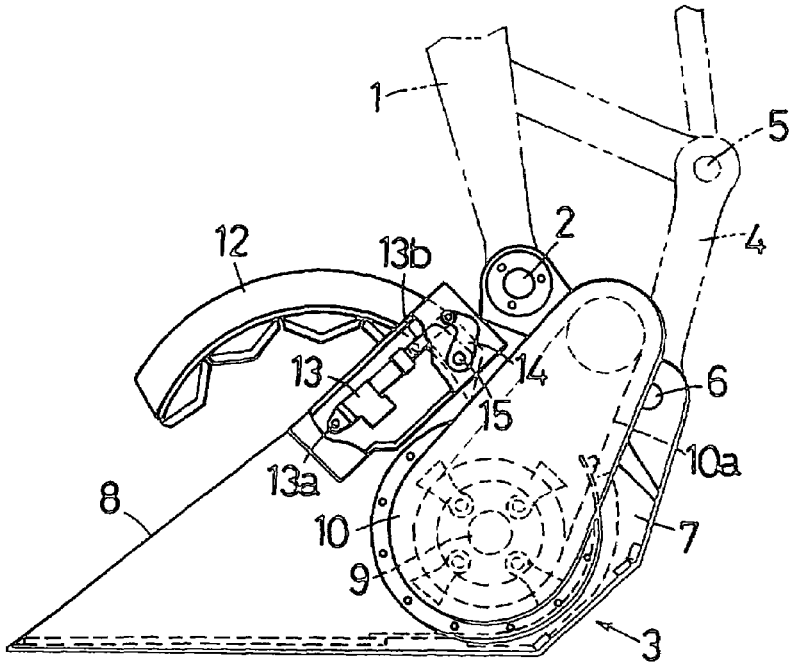
FIG. 1 is a side view of a crusher bucket with a crushing lid according to a first embodiment of the present invention.
Figure 2:
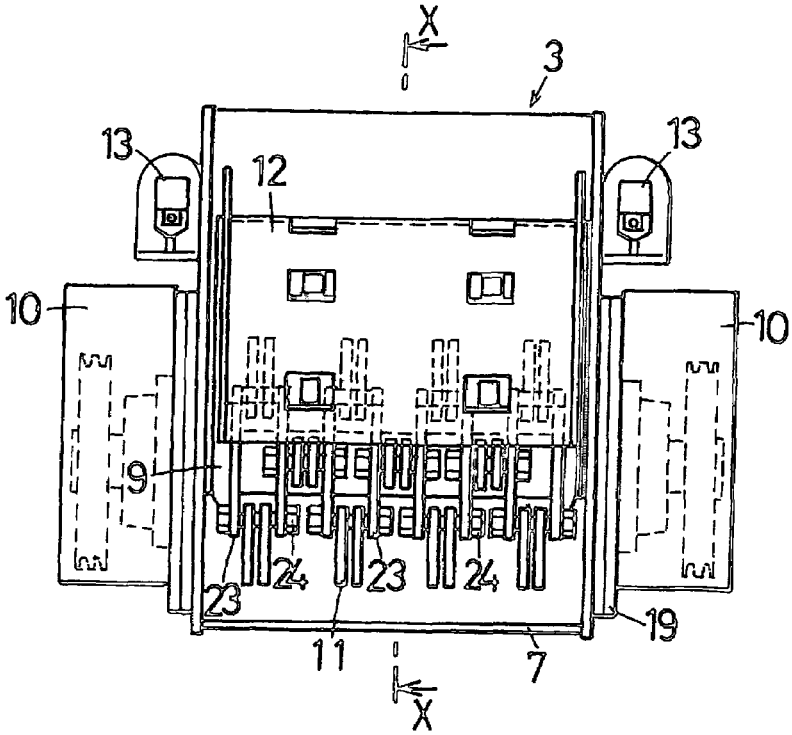
FIG. 2 is a front view of the crusher bucket according to the first embodiment of the present invention.
Figure 3:
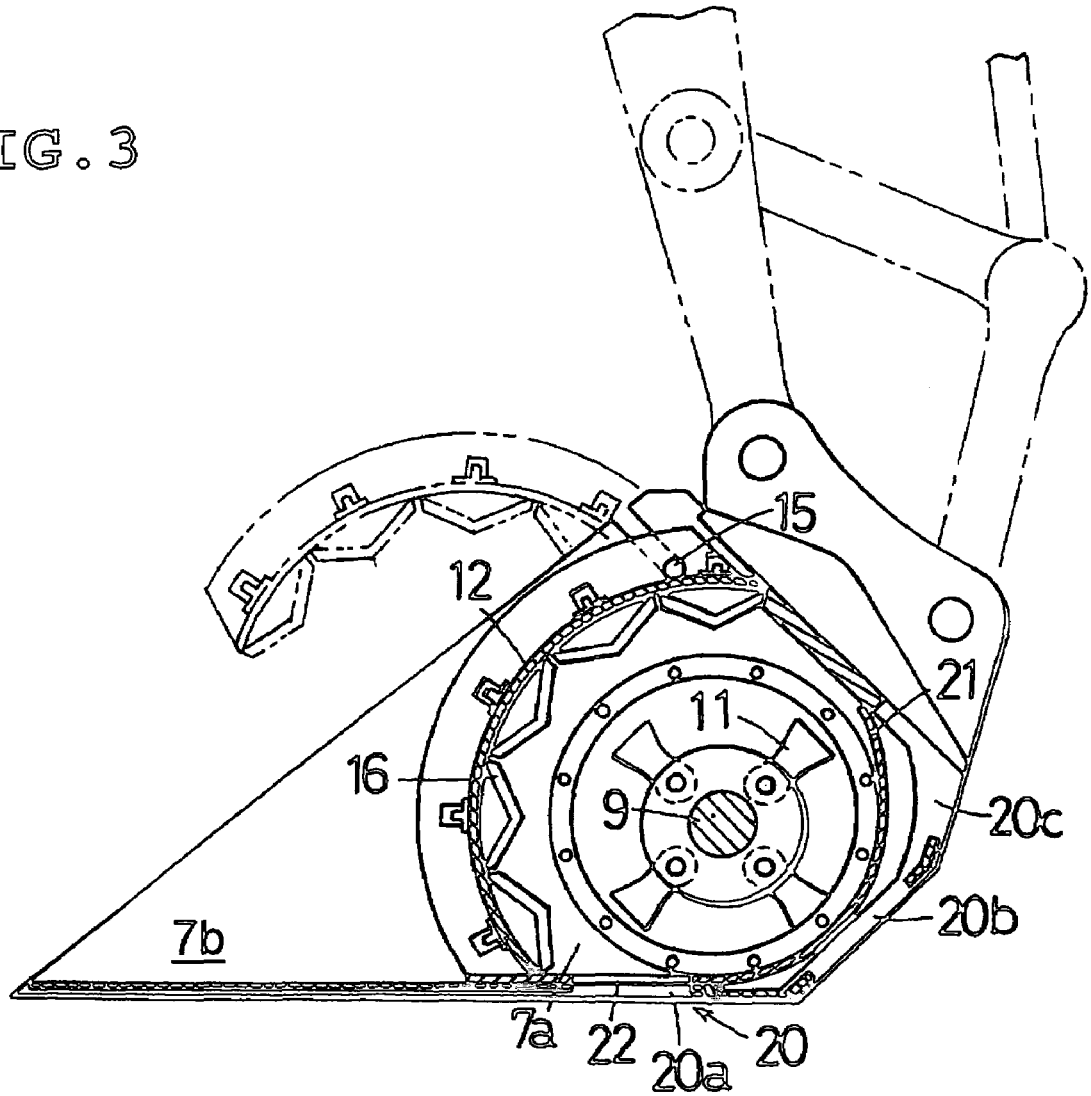
FIG. 3 is a sectional view taken along the line X-X in FIG. 2.
Figure 4:
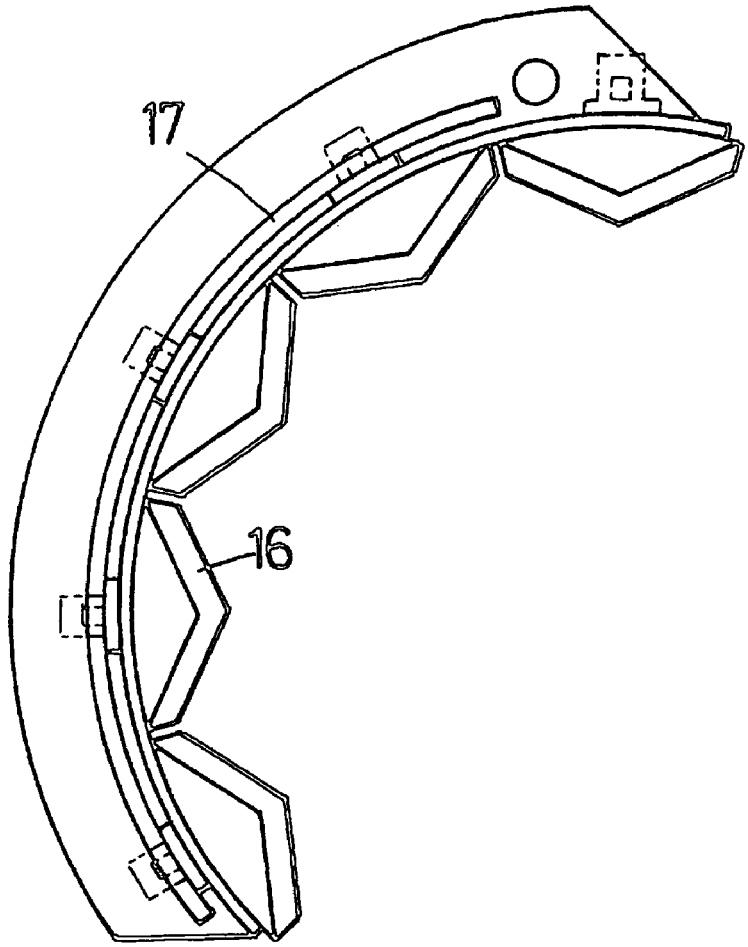
FIG. 4 is a side view showing the crushing lid provided with repulsion plate liners and a first scatter preventing member.
Figure 5:
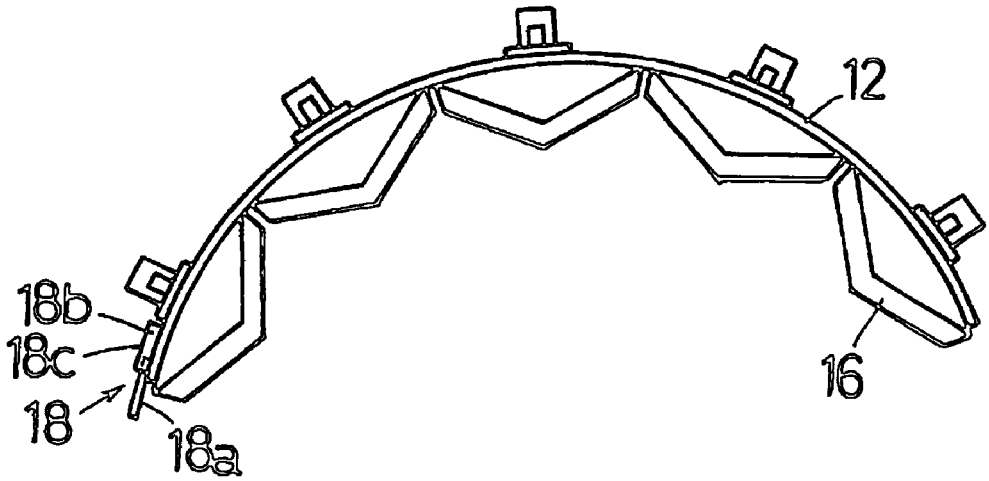
FIG. 5 is a side view showing the crushing lid provided with the repulsion plate liners and a second scatter preventing member.
Figure 6:
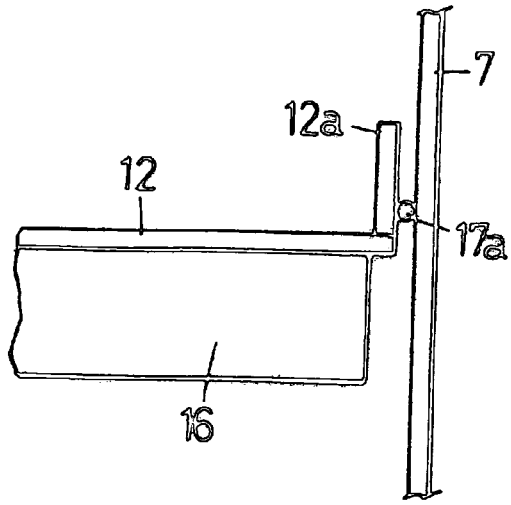
FIG. 6 is a fragmentary view showing the arrangement of the crushing lid equipped with the first scatter preventing member.

A first embodiment of the crusher bucket according to the present invention will be described below in detail with reference to FIGS. 1 to 6. FIG. 1 is a side view of a crusher bucket with a crushing lid according to the present invention. FIG. 2 is a front view of the crusher bucket. FIG. 3 is a sectional side view taken along the line X-X in FIG. 2, which corresponds to FIG. 1. FIG. 4 is a side view of the crushing lid in a state where it has repulsion plate liners attached to the inner wall thereof and a first scatter preventing member attached to one side wall thereof. FIG. 5 is a side view of the crushing lid in a state where it has repulsion plate liners attached to the inner wall thereof and a second scatter preventing member attached to the distal end thereof. FIG. 6 is a fragmentary view showing the arrangement of the crushing lid equipped with the first scatter preventing member.

A backhoe to which the crusher bucket according to the present invention is applied is a civil engineering machine of the same kind as a power shovel and is a publicly known excavator. Therefore, a detailed description of the backhoe is omitted. The backhoe is generally used for excavation of earth below the machine to perform an operation such as digging a hole, a trench, etc.

An arm 1 has a bucket 3 pivotably provided at the distal end thereof through a pivot shaft 2. The arm 1 is provided with a bucket cylinder (not shown). The distal end of a piston rod of the bucket cylinder is relatively rotatably connected to one end of a connecting member 4 through a shaft 5. The other end of the connecting member 4 is relatively rotatably attached to a bucket body 7 through a shaft 6. That is, when the piston rod is advanced or retracted by driving force of the bucket cylinder, the bucket body 7 pivots about the pivot shaft 2.

The bucket 3 is movable to any position within a given turning range by the operation of the backhoe body and can also change its direction. The bucket body 7 of the bucket 3 is used to scoop up raw material (material to be crushed), e.g. lumps of asphalt or concrete, and to load them into the inside of the bucket body 7 to crush and to transport the crushed material.

The crusher bucket will be described as a bucket that has in its bottom a discharge opening for discharging pieces of raw material crushed to a predetermined size. In addition, the bucket has a mesh grate attached to the discharge opening to adjust the particle size, and further has a rotor that crushes loaded raw material by impacting it with hammers serving as breaking teeth, as will be explained later. The top of the bucket body 7 of the bucket 3 is provided with an opening 8 for loading scrap or other raw material into the bucket body 7. A rotor shaft 9 is rotatably provided on the bucket body 7 and driven by a rotor driving device 10 disposed outside the bucket body 7.

The rotor shaft 9 has a plurality (8 in the first embodiment) of disks 23 disposed thereon at predetermined regular spacings. The rotor shaft 9 and the disks 23 in combination constitute a rotor. Headed hammer pivot shafts 24 are provided to extend between each pair of adjacent disks 23 at respective positions on the outer peripheral portion of each disk 23 angularly spaced from each other by 90°. The other ends of the hammer pivot shafts 24 are threaded and have respective nuts screwed onto them. Each hammer pivot shaft 24 has two hammers 11 pivotably provided thereon. The details of the connecting mechanism for the hammer pivot shafts 24 and the hammers 11 will be described later.

Thus, the rotor shaft 9 has a plurality of hammers 11 pivotably secured thereto. When the rotor shaft 9 rotates, the hammers 11 repetitively strike (beat) and crush raw material. The hammers 11 are mounted in such a manner as to be replaceable when becoming worn or damaged, as will be described later. The hammers 11 are formed from a rigid and wear-resistant metallic material. Thus, the hammers 11 are individually replaceable with new ones when their striking surfaces have become worn or damaged.

When the crushing lid 12 is closed or half open, the inside of the bucket body 7 defines a crushing chamber 7*a* that is used to crush raw material loaded thereinto (see FIG. 3). The inner wall of the crushing chamber 7*a* is covered with a rigid material. A crushing lid 12 is provided on the top of the bucket body 7. A lid opening-closing cylinder (opening-closing device) 13 is pivotably provided through a shaft 13*a* on the bucket body 7 to allow the crushing lid 12 to be selectively opened or closed.

During crushing of raw material in the crushing chamber 7*a*, the crushing lid 12 is closed to prevent scattering of pieces of crushed material from the opening 8 to the outside of the bucket body 7. The distal end of a piston rod 13*b* of the lid opening-closing cylinder 13 is connected to one end of the crushing lid 12 through a lever 14 and a shaft 15. Consequently, when the lid opening-closing cylinder 13 is driven, the crushing lid 12 pivots about the shaft 15 provided on the bucket body 7. Thus, the crushing lid 12 is selectively opened or closed in response to the operation of the cylinder 13.

The lever 14 is secured to the shaft 15, and the distal end of the piston rod 13*b* is connected to the lever 14. In response to the advancing or retracting movement of the piston rod 13*b*, the crushing lid 12 is closed or opened through the lever 14 and the shaft 15. In FIG. 3, the crushing lid 12 in its closed position is shown by the solid lines. The crushing lid 12 in its open position is shown by the chain double-dashed lines. Although the opening-closing device has been described as the lid opening-closing cylinder 13, it may be other actuator, for example, a hydraulic motor, or an electric motor used in combination with a thread member.

The crushing lid 12 has a repulsion plate liner 16 for crushing secured to the inner wall thereof. The repulsion plate liner 16 is formed in an approximately V-shape in section such that the center thereof projects radially inward of the crushing lid 12. The crushing lid 12 in the first embodiment has a plurality of repulsion plate liners 16 secured to the inner wall thereof. The repulsion plate liners 16 are formed from a rigid material and individually replaceable with new ones when they have become worn or damaged by a crushing operation.

Because the repulsion plate liners 16 are formed in an approximately V-shape in section, raw material can be readily crushed by colliding against the V-shaped projecting portions of the repulsion plate liners 16. Thus, the crushing effect is further improved. The crushing lid 12 has an approximately circular arc shape so that when closed, the crushing lid 12 extends in conformity to the orbit of the rotating hammers 11. When closed, the crushing lid 12 cooperates with the bucket body 7 to define a crushing chamber 7*a* in which raw material is crushed by the rotation of the hammers 11 of the rotor.

Next, the scatter preventing structure will be described. The crushing lid 12 according to the first embodiment is provided with scatter preventing members at widthwise and distal end portions thereof. Regarding the widthwise portion, as shown in FIG. 4, a first scatter preventing member 17 is secured to each side surface of the crushing lid 12 in a circular arc shape along the lid configuration. The configuration of the first scatter preventing member 17 corresponds to the inner wall of the bucket body 7.

The first scatter preventing member 17 is provided on a reinforcing wall 12*a* of the crushing lid 12. An adequate gap is provided between the reinforcing wall 12*a* and the inner wall of the bucket body 7. The first scatter preventing member 17 is provided to fill the gap. The first scatter preventing member 17 is secured to the reinforcing wall 12*a* of the crushing lid 12 by welding or using screws. The first scatter preventing member 17 secured to the reinforcing wall 12*a* is in line contact with the inner wall of the bucket body 7. Alternatively, the first scatter preventing member 17 faces the inner wall of the bucket body 7 across a gap of about 1 to 3 mm. The gap is set so that there is no interference with the lid opening-closing operation.

The first scatter preventing member 17 has a circular sectional configuration. FIG. 6 shows a round rod material 17*a* bent in a circular arc shape and secured to the reinforcing wall 12*a* by welding. Further, as shown in FIG. 5, a second scatter preventing member 18 is provided on the distal end portion of the crushing lid 12.

The second scatter preventing member 18 has a closure member 18*a* coming into direct contact with the bottom wall of the bucket body 7. The closure member 18*a* is urged by a spring member 18*b* and retained by a plate 18*c* so that the closure member 18*a* retractably projects from the distal end of the crushing lid 12. The second scatter preventing member 18 extends over the entire width of the crushing lid 12. When the crushing lid 12 is closed, the distal end of the closure member 18*a* comes in close contact with the bottom wall of the bucket body 7 so that the crushing chamber 7*a* is closed.

A rotor driving device 10 for driving the rotor shaft 9 is provided on a side wall of the bucket body 7. The rotor driving device 10 has a hydraulic motor to rotate the rotor shaft 9 through a V-belt 10*a*. In this embodiment, two rotor driving devices 10 with the same arrangement are provided on both sides of the bucket body 7. Provision of two identical rotor driving devices 10 on both sides of the bucket body 7 improves the rotational balance of the rotor shaft 9 and hence allows the rotor shaft 9 to rotate smoothly. Moreover, an increased torque can be obtained.

Further, because the rotor shaft 9 is driven through a V-belt 10*a*, vibrations transmitted to the bucket body 7 and noise generated owing to the drive of the rotor shaft 9 are reduced in comparison to the type of driving system in which the rotor driving device is connected directly to the rotor shaft 9. Further, the V-belt 10*a* absorbs shock applied to the rotor driving system owing to rapid rotation, a forward-backward switching operation, or sudden overloading during crushing. Therefore, damage to the power transmission parts or the motor can be prevented. The rotor driving device 10 does not limit the rotational direction of the rotor shaft 9 but allows selection between forward and backward rotations by a switching operation. As a result, crushing of raw material is accelerated, and the crushing efficiency increases. The rotor driving device 10 is, although not shown in detail, supported by a housing 19 that is secured to one side wall of the bucket body 7. The driving system is connected to the rotor shaft 9 in the bucket body 7.

Meanwhile, pieces of raw material crushed to a predetermined size drop to the bottom of the bucket body 7. The bottom of the bucket body 7 is provided with three discharge openings 20. The crushed or ground materials are discharged from the discharge openings 20. Usually, the discharge openings 20*b* and 20*c* in the side wall of the bucket body 7 are covered with a cover 21 with a view to enhancing the crushing effect. Pieces of crushed material are discharged only from the discharge opening 20*a* that corresponds to the position where the crushed material drops. The other discharge openings 20*b* and 20*c* are used for maintenance and so forth.

The discharge opening 20*a* is provided with a grate 22, which is a wire net of a predetermined mesh size, or a perforated steel plate, to pass only pieces of crushed material having a predetermined particle size. Regarding the grate 22, an appropriate mesh shape, size and material are selected according to each particularly crushing purpose. Consequently, pieces of crushed material capable of passing through the discharge opening 20*a* are always those smaller than a predetermined size. Coarse pieces of crushed material that cannot pass through the discharge opening 20*a* are discharged from the opening 8 when the bucket 3 is turned upside down.

[First Hammer Removably Securing Mechanism]

Figure 7:
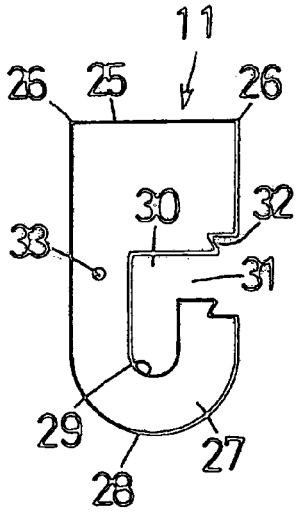
FIGS. 7(*a*) and 7(*b*) are a front view and a right-hand side view, respectively, showing a hammer used in a first hammer removably securing mechanism.
Figure 7:
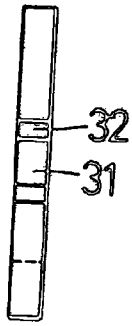

FIGS. 7(*a*) and 7(*b*) show the details of a hammer 11. FIG. 7(*a*) is a front view, and FIG. 7(*b*) is a right-hand side view. The hammer 11 is constructed by using a steel plate material capable of withstanding striking. The hammer 11 has a striking end 25 formed with two corners 26 of 90 degrees. The other end of the hammer 11, i.e. root 27, is in the shape of a semicircular arc 28. A shaft hole 29 is formed at the center of the semicircular arc 28. A hammer pivot shaft 24 as described above is inserted to extend through the shaft hole 29. The shaft hole 29 forms a bearing for mounting the hammer 11 in such a manner that the hammer 11 is pivotable about the hammer pivot shaft 24 within a predetermined angle range.

Figure 8:
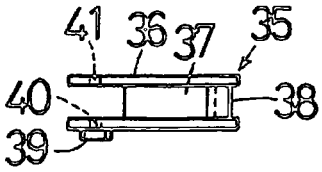
FIGS. 8(*a*) and 8(*b*) are a plan view and a front view, respectively, showing a hammer retainer used in the first hammer removably securing mechanism.
Figure 8:
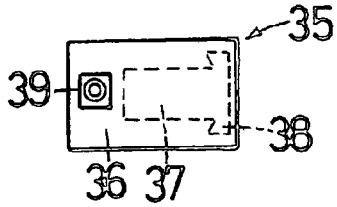

An L-shaped cut portion 30, which is a space, is formed contiguous with the shaft hole 29. The cut portion 30 allows the hammer 11 to be removed from the hammer pivot shaft 24 without the need to remove the shaft 24 when the hammer 11 that has become worn is replaced with a new one. Dovetail grooves 32 are formed at the opposite ends of an opening 31 of the cut portion 30. In addition, a bolt through-hole 33 is formed in the neighborhood of the cut portion 30. FIGS. 8(*a*) and 8(*b*) show a hammer retainer. FIG. 8(*a*) is a plan view, and FIG. 8(*b*) is a front view. It should be noted that the dovetail groove 32 is a groove with a dove's tail-shaped sectional configuration, and a corresponding dovetail projection is fitted into the groove to form an interlocking joint, which is known as "dovetail joint".

The hammer retainer 35 is assembled into and secured to the hammer 11 mounted on the hammer pivot shaft 24 so that the hammer 11 will not undesirably disengage from the hammer pivot shaft 24. The hammer retainer 35 has two rectangular side plates 36 placed parallel to each other and an insert portion 37 formed between the side plates 36 integrally therewith. The insert portion 37 is to be inserted into the opening 31 of the hammer 11. The insert portion 37 is formed with dovetail projections 38 complementary in dovetail joint configuration to the dovetail grooves 32. The dovetail projections 38 are portions to be fitted into the dovetail grooves 32.

One side plate 36 is integrally provided with a bolt head protecting member 39. The center of the bolt head protecting member 39 is provided with a hole for receiving the head of a bolt 43 (see FIG. 10). The bolt 43 is used to secure the hammer retainer 35 to the hammer 11. The bolt head protecting member 39 covers the outer periphery of the head of the bolt 43 to prevent wear of the bolt 43, thereby preventing the hammer retainer 35 from falling off the hammer 11. The side plate 36 is provided with a through-hole 40 for passing the bolt 43. A tapped hole 41 into which the bolt 43 is threaded is formed in the other side plate 36 in coaxial relation to the through-hole 40.

Figure 9:
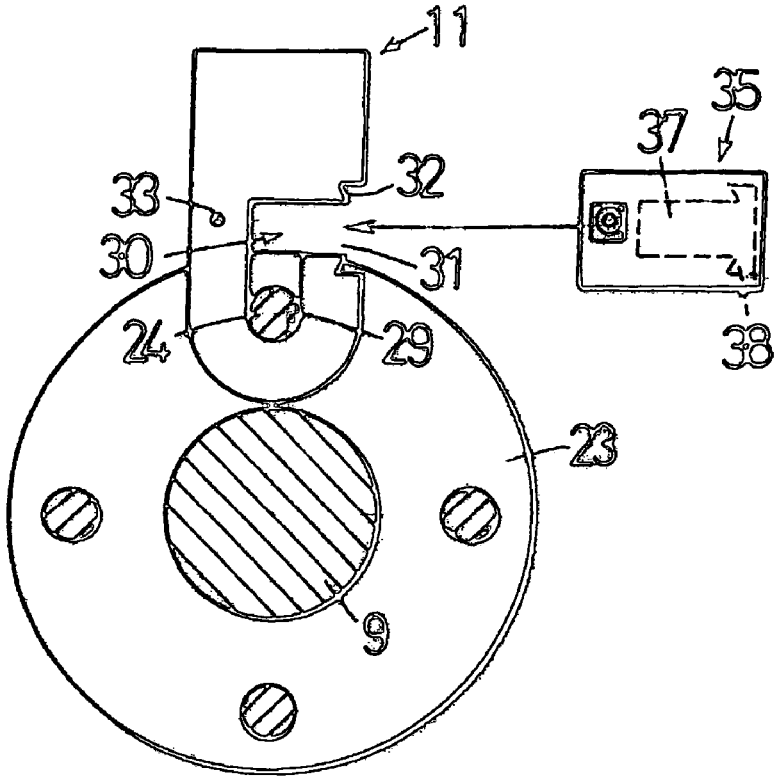
FIG. 9 is an explanatory view showing an assembly procedure performed to mount a hammer on a hammer pivot shaft with the first hammer removably securing mechanism.
Figure 10:
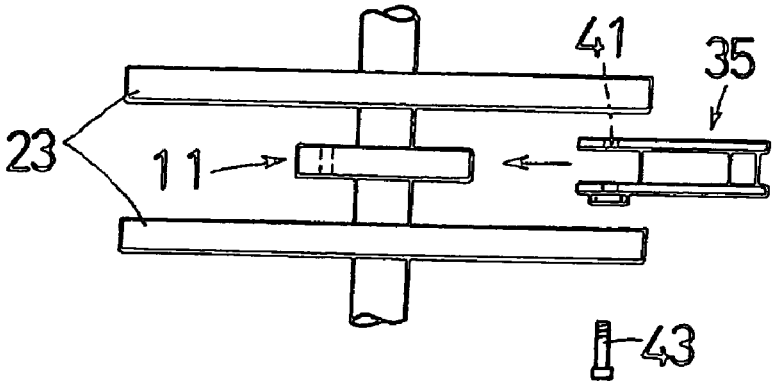
FIG. 10 is a plan view of FIG. 9.
Figure 11:
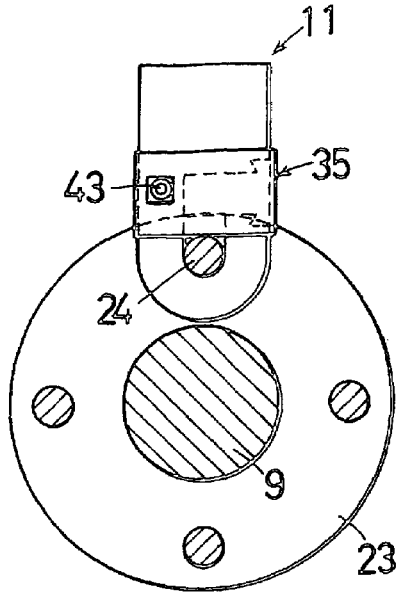
FIG. 11 is an explanatory view showing a state where the process of mounting the hammer on the hammer pivot shaft with the first hammer removably securing mechanism has been completed.

FIGS. 9 to 11 are explanatory views showing an assembly procedure performed to mount a hammer 11 on a hammer pivot shaft 24. As shown in FIG. 9, the hammer 11 is provided with a cut portion 30 with an opening 31. Therefore, the hammer pivot shaft 24 can be inserted into the shaft hole 29 of the hammer 11 through the opening 31. Thus, the hammer pivot shaft 24 need not be removed from the disks 23 to mount the hammer 11.

In the state shown in FIG. 9, the hammer retainer 35 is fitted to the hammer 11 from the direction of the arrow shown in FIG. 10. More specifically, the insert portion 37 and the dovetail projections 38 of the hammer retainer 35 are respectively fitted into the opening 31 and the dovetail grooves 32 of the hammer 11. Then, the bolt 43 is inserted into the through-hole 40 of the hammer retainer 35 at the outer periphery of one disk 23 and from the outside thereof. After being inserted through the through-hole 40 of the hammer retainer 35 and the through-hole 33 of the hammer 11, the bolt 43 is threaded into the tapped hole 41, thereby securing the hammer 11 and the hammer retainer 35 to each other (see FIG. 11).

The other hammer 11, which pairs with the above-described hammer 11, is fitted onto and secured to the hammer pivot shaft 24 in the same way as the above. At this time, a bolt 43 is threaded into a tapped hole 41 of an associated hammer retainer 35 at the outer periphery of the other disk 23 and from the outside thereof to secure the hammer 11 and the hammer retainer 35 to each other. In this embodiment, two hammers 11 are mounted on one hammer pivot shaft 24 (see FIG. 2). As has been detailed above, a worn or damaged hammer 11 can be readily replaced with a new one simply by untightening the bolt 43 without the need to remove the hammer pivot shaft 24.

[Second Hammer Removably Securing Mechanism]

Figure 12:
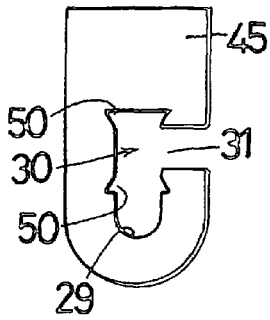
FIGS. 12(*a*) and 12(*b*) are a front view and a right-hand side view, respectively, showing a hammer used in a second hammer removably securing mechanism.
Figure 12:
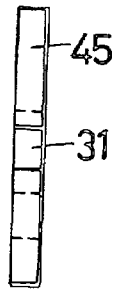

The following is a description of a second hammer removably securing mechanism having a hammer and a hammer retainer different in configuration from the above-described hammer 11 and hammer retainer 35. FIGS. 12(*a*) and 12(*b*) show the details of a hammer 45. FIG. 12(*a*) is a front view, and FIG. 12(*b*) is a right-hand side view. The basic configuration of the hammer 45 is the same as that of the above-described hammer 11. Therefore, the same structures are denoted by using the same reference numerals, and a description thereof is omitted. Only the features in which the hammer 45 differs from the hammer 11 will be explained below.

Figure 13:
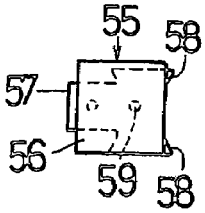
FIGS. 13(*a*) and 13(*b*) are a front view and a right-hand side view, respectively, showing a first hammer retainer member of the second hammer removably securing mechanism.
Figure 13:
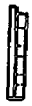
Figure 13:
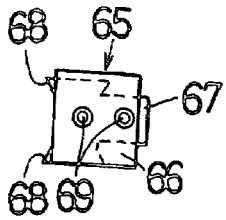
Figure 13:
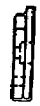

The hammer 45 has dovetail grooves 50 formed at both sides of the opening 31 in the cut portion 30. The dovetail grooves 50 are portions to be fitted with dovetail projections 58 and 68 (described later). Insertion of the dovetail projections 58 and 68 in the dovetail grooves 50 prevents the opening 31 from being undesirably enlarged when the hammer 45 is subjected to centrifugal force. FIGS. 13(*a*), 13(*b*), 13(*c*) and 13(*d*) show a hammer retainer. The retainer comprises a first hammer retainer member 55 and a second hammer retainer member 65. FIGS. 13(*a*) and 13(*b*) are a front view and a right-hand side view, respectively, showing the first hammer retainer member 55 of the second hammer removably securing mechanism. FIGS. 13(*c*) and 13(*d*) are a front view and a left-hand side view, respectively, showing the second hammer retainer member 65 of the second hammer removably securing mechanism.

The first and second hammer retainer members 55 and 65 are fitted into the hammer 45 mounted on the hammer pivot shaft 24 to prevent the hammer 45 from falling off the shaft 24. The first hammer retainer member 55 has a rectangular side plate 56 and an insert portion 57 integrally formed on one side of the side plate 56. The insert portion 57 is to be inserted into the opening 31 of the hammer 45. The insert portion 57 has dovetail projections 58 formed on both ends thereof. The dovetail projections 58 are complementary in dovetail joint configuration to the dovetail grooves 50 of the hammer 45. The dovetail projections 58 are portions to be fitted into the dovetail grooves 50. The side plate 56 is formed with two tapped holes 59.

Similarly, the second hammer retainer member 65 has a rectangular side plate 66 and an insert portion 67 integrally formed on one side of the side plate 66. The insert portion 67 is to be inserted into the opening 31 of the hammer 45, together with the insert portion 57 of the first hammer retainer member 55. The insert portion 67 has dovetail projections 68 formed on both ends thereof. The dovetail projections 68 are complementary in dovetail joint configuration to the dovetail grooves 50 of the hammer 45. The dovetail projections 68 are to be fitted into the dovetail grooves 50, together with the dovetail projections 58 of the first hammer retainer member 55. The side plate 66 is formed with two bolt head protecting members 69.

Figure 14:
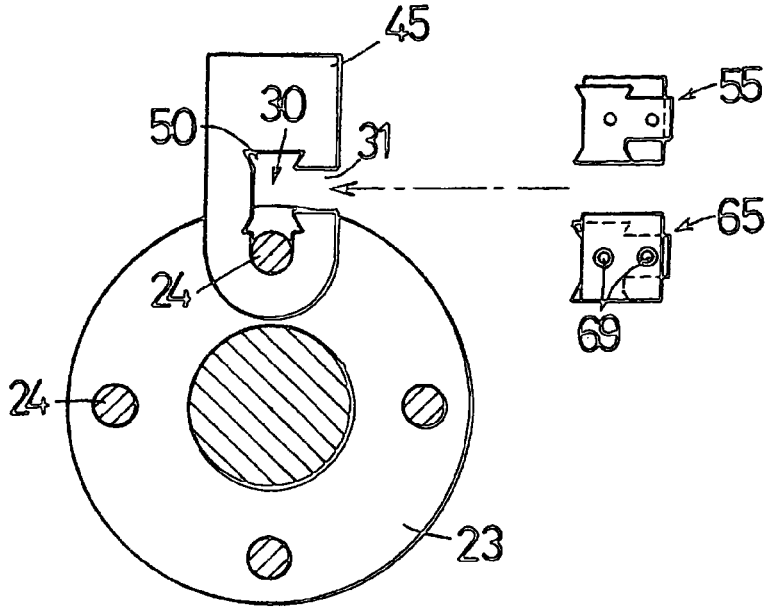
FIG. 14 is an explanatory view showing an assembly procedure performed to mount a hammer on a hammer pivot shaft with the second hammer removably securing mechanism.
Figure 15:
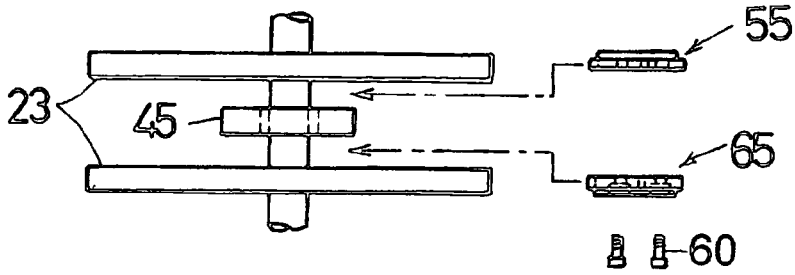
FIG. 15 is a plan view of FIG. 14.
Figure 16:
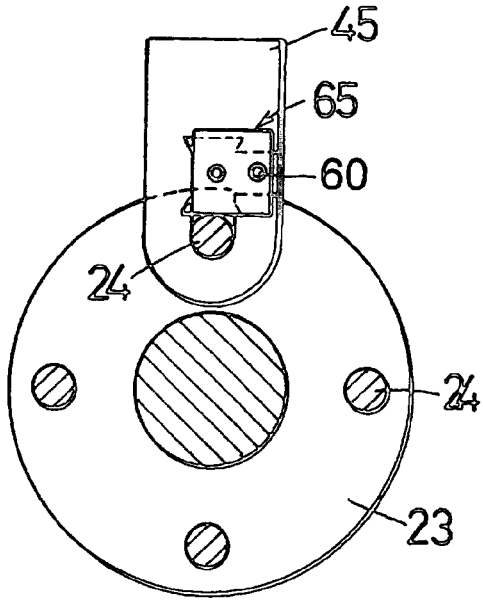
FIG. 16 is an explanatory view showing a state where the process of mounting the hammer on the hammer pivot shaft with the second hammer removably securing mechanism has been completed.

FIGS. 14 to 16 are explanatory views showing an assembly procedure performed to mount the hammer 45 on the hammer pivot shaft 24. As shown in FIG. 14, the hammer 45 is mounted on the hammer pivot shaft 24, and in this state the first and second hammer retainer members 55 and 65 are inserted between the disks 23 (in the arrow direction in FIG. 15) and positioned to face each other across the hammer 45. Then, the insert portion 57 and the dovetail projections 58 of the first hammer retainer member 55 are respectively fitted into the opening 31 and the dovetail grooves 50 of the hammer 45. Further, the insert portion 67 and the dovetail projections 68 of the second hammer retainer member 65 are respectively fitted into the opening 31 and the dovetail grooves 50 of the hammer 45.

As the result of the fitting process, the insert portion 57 and the dovetail projections 58 of the first hammer retainer member 55 respectively face and contact the insert portion 67 and the dovetail projections 68 of the second hammer retainer member 65. Bolts 60 are inserted into the respective through-holes of the bolt head protecting members 69 of the second hammer retainer member 65 at the outer periphery of one disk 23 and from the outside thereof. Then, the bolts 60 are respectively threaded into the tapped holes 59 of the first hammer retainer member 55, thereby securing the hammer 45 and the first and second hammer retainer members 55 and 65 to each other (see FIG. 16).

[Raw Material Crushing Method by the First Embodiment]

The raw material crushing method carried out by the crusher bucket 3 according to the first embodiment will be described below. First, the crushing lid 12 of the bucket 3 is closed to begin a crushing operation. Raw material is scooped up by the forward end portion of the bucket body 7 in a state where the crushing lid 12 is closed. The raw material is loaded into the front portion of the bucket body 7, that is, a space 7*b* defined between the bucket body 7 and the outer wall of the crushing lid 12 when closed. Next, the crushing lid 12 is gradually opened to feed the raw material into the crushing chamber 7*a* defined between the bucket body 7 and the inner wall of the crushing lid 12. At this time, the rotor shaft 9 is rotating. Therefore, the raw material is crushed little by little by repetitive strikes of the hammers 11 and the effect of striking against the repulsion plate liners 16 of the crushing lid 12. Pieces of crushed material are discharged from the discharge opening 20*a* in the bottom of the bucket body 7. That is, in the first embodiment, a material feed rate adjusting mechanism is formed from the crushing lid 12, the cylinder 13 for opening or closing the crushing lid 12, etc. The amount of material to be fed to the crushing chamber 7*a* is adjusted by an operator adjusting the angle of opening of the crushing lid 12.

When all the scooped raw material has been crushed, the crushing lid 12 is closed again. Then, raw material is scooped up by the bucket body 7, and the above-described operation is repeated. Thus, raw material is crushed in the bucket body 7 little by little while the crushing rate and the shape and size of crushed particles are adjusted by adjustingly opening or closing the crushing lid 12. Accordingly, the rotating operation of the rotor shaft 9 is stabilized. In contrast to the conventional method in which raw material is fully loaded into the bucket body 7 and crushed at one stroke, the first embodiment of the present invention gradually crushes raw material and therefore can avoid an overload that might otherwise occur during crushing. At the same time, the crusher according to the first embodiment crushes raw material while preventing scattering of crushed material. Therefore, it is possible to perform a crushing operation that is favorable from the safety and environment point of view. In addition, there is substantially no possibility that raw material will be undesirably caught between the bucket body 7 and the hammers 11 or the rotor.

The raw material is crushed not only by impact but also by repetitively rubbing against other raw material intermingling therewith in the crushing chamber 7*a* as the rotor shaft 9 rotates. Thus, the crusher according to this embodiment repeats the crushing operation many times while impacting the raw material and therefore can perform efficient crushing. Because this operation is carried out by two rotor driving devices 10, the motor of each rotor driving device 10 need not be large in size. Accordingly, a well-balanced rotation can be obtained for crushing. Pieces of raw material crushed to a particle size less than a predetermined one are discharged from the discharge opening 20*a* to the outside of the bucket body 7. If raw material remains uncrushed in the bucket body 7 for some reason, the bucket body 7 is turned upside down, and the raw material or coarse pieces of crushed material are discharged from the opening 8.

[A Crusher Bucket with a Crushing Lid According to a Second Embodiment]

A second embodiment of the crusher bucket according to the present invention will be described below.

In the following description of the second embodiment of the crusher bucket, the same members or portions as those in the above-described first embodiment are denoted by using the same reference numerals, and a detailed description thereof is omitted. Only the features in which the second embodiment differs from the first embodiment will be explained below.

Figure 17:
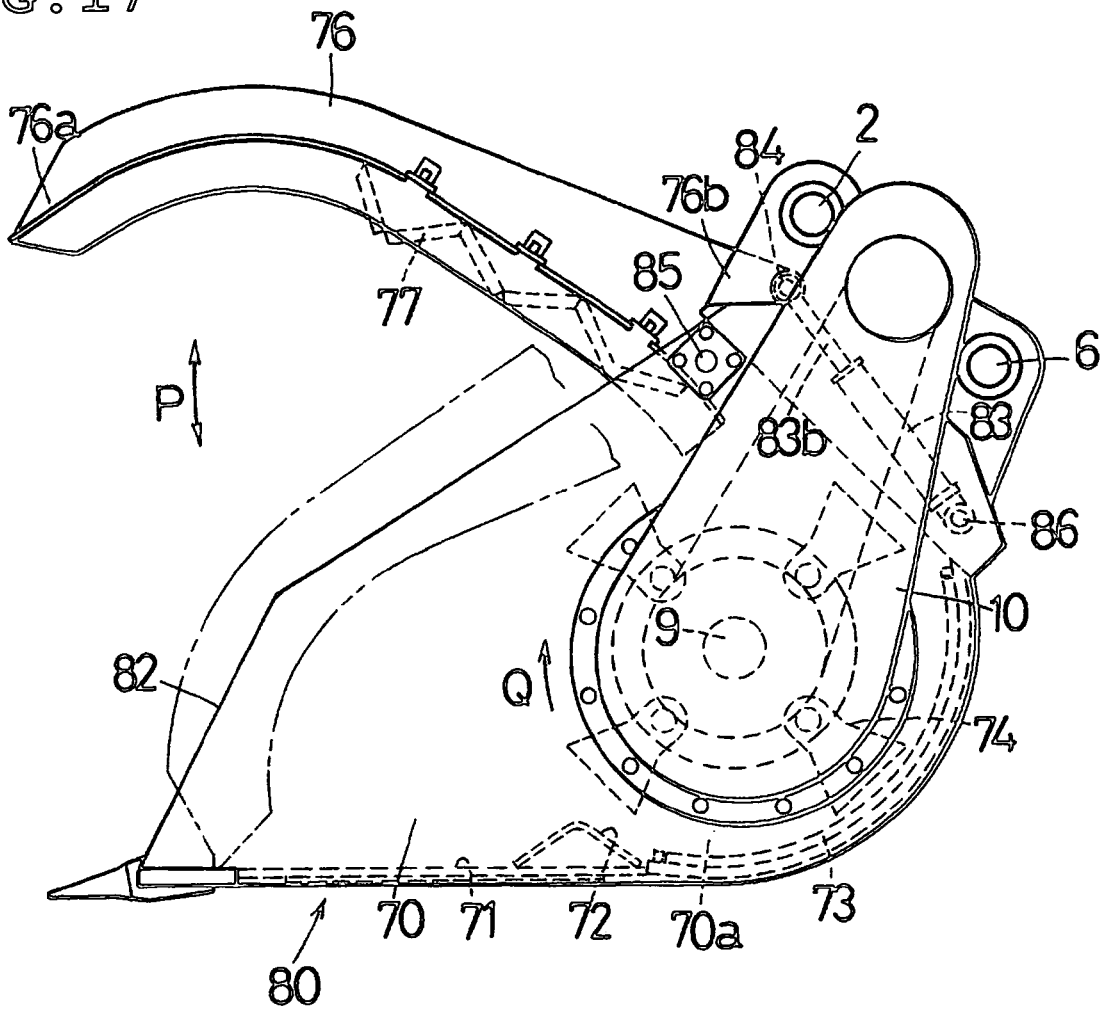
FIG. 17 is a side view of a crusher bucket with a crushing lid according to a second embodiment of the present invention.

FIG. 17 is a side view of a crusher bucket that has a weir provided on the bottom wall of the bucket body.

A bucket 80 is pivotably provided at the distal end of an arm (not shown) through a pivot shaft 2. The arm is provided with a bucket cylinder (not shown). The distal end of a piston rod of the bucket cylinder is relatively rotatably connected to one end of a connecting member (not shown) through a shaft. The other end of the connecting member is relatively rotatably attached to a bucket body 70 through a shaft 6. That is, when the piston rod is advanced or retracted by driving force of the bucket cylinder, the bucket body 70 pivots about the pivot shaft 2.

The bucket 80 is movable to any position within a given turning range by the operation of the backhoe body and can also change its direction. The bucket body 70 of the bucket 80 is used to scoop up raw material (material to be crushed), e.g. lumps of asphalt or concrete, and to load them into the inside of the bucket body 70 to crush and to transport pieces of crushed material.

The crusher bucket has in its bottom a discharge opening for discharging pieces of raw material crushed to a predetermined size, and further has a mesh grate 73 attached to the discharge opening to adjust the particle size. The bucket has the function of crushing raw material loaded therein by impacting it with hammers 74. The top of the bucket body 70 of the bucket 80 is provided with an opening 82 for loading scrap or other raw material to be crushed. A weir 72 serving as a material feed rate adjusting member is provided on a scooping surface portion 71 defined by the bottom wall of the bucket body 70. The weir 72 is preferably secured to the scooping surface portion 71 by welding, deposition, bonding, or using securing members such as bolts.

The weir 72 controls the feed of scooped raw material so that the raw material will not be fed into the crushing chamber 70*a* at one stroke. That is, the amount of raw material passing over the weir 72 and fed into the crushing chamber 70*a* is adjusted by an operator adjusting the angle of pivot of the bucket body 70. It should be noted that the outer wall surface of the weir 72 is preferably covered with a rigid material.

A rotor shaft 9 is rotatably provided on the bucket body 70 and driven by a rotor driving device 10 disposed outside the bucket body 70.

The rotor shaft 9 has a plurality of disks disposed thereon at predetermined regular spacings (see FIG. 2). The rotor shaft 9 and the disks in combination constitute a rotor. Headed hammer pivot shafts are provided to extend between each pair of adjacent disks at respective positions on the outer peripheral portion of each disk spaced from each other by a predetermined angle. The hammer pivot shafts have hammers 74 pivotably provided thereon. The arrangement of the hammer pivot shaft-and-hammer connecting mechanism is the same as that described above with regard to the first or second hammer removably securing mechanism. That is, each hammer 74 is secured by a hammer retainer 35, or a combination of a first hammer retainer member 55 and a second hammer retainer member 65.

The basic configuration of the hammers 74 is the same as that of the above-described hammers 11 and 45. Therefore, a detailed description thereof is omitted. The hammers 74 are preferably formed by using a rigid and wear-resistant metallic material.

Thus, the rotor shaft 9 has a plurality of hammers 74 pivotably secured thereto. When the rotor shaft 9 rotates, the hammers 74 repetitively strike (beat) and crush the raw material. The hammers 74 are mounted in such a manner as to be replaceable when becoming worn or damaged. The hammers 74 are formed from a rigid and wear-resistant metallic material. Thus, the hammers 74 are individually replaceable with new ones when their striking surfaces have become worn or damaged.

When the crushing lid 76 is closed, the inside of the bucket body 80 defines a crushing chamber 70*a* that is used to crush raw material loaded thereinto (see FIG. 17). The inner wall of the crushing chamber 70*a* is covered with a rigid material. The crushing lid 76 is provided on the top of the bucket body 70 in such a manner as to be pivotable about a shaft 85 so as to be selectively opened or closed. A lid opening-closing cylinder 83 is pivotably provided through a shaft 86 on the bucket body 70 to allow the crushing lid 76 to be selectively opened or closed. A piston rod 83*b* of the lid opening-closing cylinder 83 is connected to the proximal end portion 76*b* of the crushing lid 76 through a shaft 84.

During crushing of raw material in the crushing chamber 70*a*, the distal end portion 76*a* of the crushing lid 76 abuts against the scooping surface portion 71 to prevent scattering of pieces of crushed material from the opening 82 to the outside of the bucket body 70. Accordingly, when the lid opening-closing cylinder 83 is driven, the crushing lid 76 pivots about the shaft 85 provided on the bucket body 70. Thus, the crushing lid 76 is opened or closed in response to the operation of the cylinder 83. In FIG. 17, the crushing lid 76 in its closed position is shown by the solid lines. The crushing lid 76 in its open position is shown by the chain double-dashed lines.

In response to the advancing or retracting movement of the piston rod 83*b*, the crushing lid 76 pivots about the shaft 85 to close or open the opening 82 of the bucket 80. The crushing lid 76 has a repulsion plate liner 77 for crushing secured to the inner wall thereof. The repulsion plate liner 77 is formed in an approximately V-shape in section such that the center thereof projects radially inward of the crushing lid 76. The crushing lid 76 in the second embodiment has a plurality of repulsion plate liners 77 secured to the inner wall thereof. The repulsion plate liners 77 are formed from a rigid material and individually replaceable with new ones when they have become worn or damaged.

[Raw Material Crushing Method by the Second Embodiment]

The raw material crushing method carried out by the crusher bucket 80 according to the second embodiment will be described below. Raw material is scooped up by the forward end portion of the bucket body 70 in a state where the crushing lid 76 is open, and loaded onto the scooping surface portion 71, which is the front bottom wall portion of the bucket body 70. At this time, the scooped raw material is dammed up by the weir 72 so that it is not fed into the crushing chamber 70*a*. After the crushing lid 76 has been closed, the bucket body 70 is tilted so that the raw material is fed into the crushing chamber 70*a* little by little by passing over the weir 72. At this time, the rotor shaft 9 is rotating in the direction of the arrow Q. Therefore, the hammers 74 strike the raw material. The raw material crushed by repetitive strikes of the hammers 74 collides against the repulsion plate liners 77 of the crushing lid 76 as well. Thus, the raw material is crushed little by little by repetitive strikes of the hammers 11, collision against the repulsion plate liners 77, collision between pieces of raw material, etc. Pieces of crushed material are discharged through the grate 73 on the bottom of the bucket body 70.

When all the scooped raw material has been crushed, the crushing lid 76 is opened again. Then, raw material is scooped up by the bucket body 70, and the above-described operation is repeated. Thus, raw material is crushed in the bucket body 70 little by little while the crushing rate and the shape and size of crushed particles are adjusted by adjusting the tilt of the bucket body 70. Accordingly, the rotating operation of the rotor shaft 9 is stabilized. In addition, there is no possibility that raw material or pieces of crushed material will be undesirably caught between the bucket body 70 and the hammers 74, etc., causing the rotor to be unable to rotate. It is also possible to avoid an overload that might otherwise occur during crushing. At the same time, the crusher according to the second embodiment crushes raw material while preventing scattering of pieces of crushed material. Therefore, it is possible to perform a crushing operation that is favorable from the safety and environment point of view.

The raw material is crushed not only by impact but also by repetitively rubbing against other raw material intermingling therewith in the crushing chamber 7*a* as the rotor shaft 9 rotates. Thus, the crusher according to this embodiment repeats the crushing operation many times while impacting the raw material and therefore can perform efficient crushing. In addition, raw material passing over the weir 72 contacts the hammers 74 at an angle close to an optimal one according to the theory of the material feeding angle of the impact crusher inlet opening. Accordingly, efficient crushing can be performed.

Further, because the crushing operation is carried out by two rotor driving devices 10, the motor of each rotor driving device 10 need not be large in size. Accordingly, a well-balanced rotation can be obtained for crushing. Pieces of raw material crushed to a particle size less than a predetermined one are discharged to the outside of the bucket body 70 from the grate 73 provided over the discharge opening of the bucket body 70.

If raw material remains uncrushed in the bucket body 70 for some reason, the bucket body 70 is turned upside down, and the raw material or coarse pieces of crushed material are discharged from the opening 82.

It should be noted that the bucket 80 may be used in a 180-degree inverted position. In such a case, the repulsion plate liners 77 play the role of the weir 72.

Although the present invention has been described by way of embodiments, it should be noted that the present invention is not necessarily limited to the foregoing embodiments but can be modified in a variety of ways without departing from the object and gist of the present invention. For example, the configuration of the weir is not limited to the triangular configuration as seen in a side view. The weir may have other configuration, for example, a trapezoidal, quadrangular, semicircular, semielliptical or plate-shaped configuration, or a combination of these configurations. The weir may have any structure, provided that when the bucket scoops up raw material, the weir dams up the raw material so that it is not fed into the crushing chamber at one stroke, and the weir allows the raw material to be fed into the crushing chamber over the weir in a predetermined amount at a time when the bucket pivots through a predetermined angle from the angle position where the raw material was scooped up into the bucket.

What is claimed is:

1. A crusher bucket comprising:

a bucket body (7, 70);

a crushing lid (12, 76) provided on said bucket body, said crushing lid being capable of being opened and closed relative to said bucket body;

a material feed rate adjusting mechanism provided on at least one of said bucket body (7, 70) and said crushing lid (12, 76) to allow raw material scooped up into said bucket body (7, 70) to be fed into a crushing chamber (7*a*, 70*a*) is adjusted by an operator adjusting a angle of pivot of said bucket body (70, 70);

hammers (11, 45, 74) disposed on an outer periphery of a rotor driven rotationally by a power drive device to strike and break said raw material fed into said crushing chamber (7*a*, 70*a*); and a repulsion plate (16, 77) provided on said crushing lid (12, 76) to collide with said raw material struck by said hammers (11, 45, 74);

a hammer pivot shaft (24) inserted into said bearing (29) through said opening (31) during assembly process to pivotably support said hammer (11, 45, 74);

a hammer retainer (35, 55, 65) inserted into said opening (31) and secured to said hammer (11, 45, 74); and a securing member (43, 60) for securing said hammer (11, 45, 74) and said hammer retainer (35, 55, 65) to each other;

wherein each of said hammers (11, 45, 74) has an opening (31) open outward and a cut portion (30) communicating with said opening (31), said cut portion being formed with a bearing (29) that supports said hammer (11, 45, 74) when said rotor rotates.

2. A crusher bucket according to claim 1, wherein said material feed rate adjusting mechanism is a weir (72) provided on a bottom wall (71) of said bucket body (70).

3. A crusher bucket according to claim 1, further comprising:

a mutually connecting mechanism whereby said hammer (11, 45, 74) and said hammer retainer (35, 55, 65) are detachably connected to each other;

said mutually connecting mechanism including:

first engaging elements (32) formed at opposite ends of said opening (31); and second engaging elements (38) to be detachably engaged with said first engaging elements (32), said second engaging elements (38) being formed on said hammer retainer (35).

4. A crusher bucket according to claim 1, wherein said hammer retainer comprises two hammer retainer members (55, 65) provided facing each other;

said crusher bucket further comprising:

a mutually connecting mechanism whereby said hammer (11, 45, 74) and said hammer retainer (35, 55, 65) are detachably connected to each other;

said mutually connecting mechanism including:

first engaging elements (50) formed at two positions in said cut portion (30) in a radial direction of said bearing (29); and second engagement elements (58, 68) to be detachably engaged with said first engaging elements (50), said second engaging elements (58, 68) being formed on said hammer retainer members (55, 65), respectively.

* * * * *